US007086554B2

(12) United States Patent
Ehret et al.

(10) Patent No.: US 7,086,554 B2
(45) Date of Patent: Aug. 8, 2006

(54) ENVIRONMENTALLY-CONTROLLED FOOD CONTAINER HAVING FRACTURE RESISTANT SEAMS

(75) Inventors: James A. Ehret, Norwalk, OH (US); Harry J. Scofield, Northfield, MN (US); Michael Brodziak, Northfield, MN (US)

(73) Assignee: FMC Technologies, Inc., Chicago, IL (US)

( * ) Notice: Subject to any disclaimer, the term of this patent is extended or adjusted under 35 U.S.C. 154(b) by 251 days.

(21) Appl. No.: 10/701,380

(22) Filed: Nov. 4, 2003

(65) Prior Publication Data

US 2005/0092757 A1 May 5, 2005

(51) Int. Cl.
*B65D 8/04* (2006.01)
*B65D 8/06* (2006.01)

(52) U.S. Cl. ..... 220/612

(58) Field of Classification Search ..... 220/612, 220/560.05, 592.02, 292.01, 592.21, 592.26, 220/678, 613, 591, 592.01; 442/6; 428/40.1, 428/40.7, 40.9, 201
See application file for complete search history.

(56) References Cited

U.S. PATENT DOCUMENTS

| | | | | | |
|---|---|---|---|---|---|
| 2,391,791 | A | * | 12/1945 | McHenry | 53/411 |
| 2,795,264 | A | * | 6/1957 | Pechy | 156/510 |
| 3,773,604 | A | * | 11/1973 | Desai et al. | 220/560.05 |
| 3,862,700 | A | * | 1/1975 | Noma et al. | 220/560.05 |
| 4,194,041 | A | | 3/1980 | Gore et al. | |
| 4,496,793 | A | | 1/1985 | Hanson et al. | |
| 4,531,278 | A | * | 7/1985 | Boykin | 29/469 |
| 4,583,378 | A | | 4/1986 | Sakamoto et al. | |
| 4,720,400 | A | | 1/1988 | Manniso | |
| 4,889,252 | A | * | 12/1989 | Rockom et al. | 229/103.11 |
| 5,095,632 | A | | 3/1992 | Hassler, Jr. et al. | |
| 5,126,185 | A | | 6/1992 | Forrest et al. | |
| 5,557,066 | A | | 9/1996 | Rostoker et al. | |
| 5,614,284 | A | | 3/1997 | Kranzler et al. | |
| 6,020,276 | A | * | 2/2000 | Hoyes et al. | 442/185 |
| 6,291,368 | B1 | * | 9/2001 | Lee | 442/6 |
| 6,408,841 | B1 | * | 6/2002 | Hirath et al. | 126/19 R |
| 6,494,338 | B1 | | 12/2002 | Schultz | |
| 6,513,703 | B1 | * | 2/2003 | Becker | 229/103.11 |
| 2002/0113117 | A1 | * | 8/2002 | Bradish | 229/199 |
| 2003/0118836 | A1 | | 6/2003 | Lee et al. | |

FOREIGN PATENT DOCUMENTS

GB 2185698 A * 7/1987

* cited by examiner

*Primary Examiner*—Jes F. Pascua
*Assistant Examiner*—Shawn Braden
(74) *Attorney, Agent, or Firm*—Pauley Petersen & Erickson

(57) ABSTRACT

An environmentally-controlled food container, such as a refrigerator, freezer or oven, includes a plurality of walls joined at their edges and joints between adjacent walls. The joints are covered by a seaming tape which includes a plastic film layer and a mesh layer. The mesh layer is formed from a material having a coefficient of thermal expansion within ±10% of a coefficient of thermal expansion of adjacent wall material. The seaming prevents moisture and bacteria from entering the joints, and does not fracture due to thermal expansion and contraction of the walls.

27 Claims, 1 Drawing Sheet

ENVIRONMENTALLY-CONTROLLED FOOD CONTAINER HAVING FRACTURE RESISTANT SEAMS

FIELD OF THE INVENTION

This invention is directed to an environmentally-controlled food container, such as a refrigerator, freezer or oven, having seams which do not fracture or otherwise fail due to thermal contraction and expansion of adjacent wall panels.

BACKGROUND OF THE INVENTION

Refrigerators, freezers and ovens used in the food industry typically include a plurality of rectangular walls joined along adjacent edges. Each wall typically includes an outer panel, an inner panel, and an insulation material between them. The outer and inner panels may be formed of steel, stainless steel, another suitable metal, or another suitable material.

The joints between the adjacent walls are typically filled with caulk to prevent moisture from entering the joints. Sometimes, the joints are also covered with batten strips. When the internal temperature is lowered, the inner wall panels contract relative to the outer wall panels. When the internal temperature is raised, the inner wall panels expand relative to the outer wall panels.

Over time, the contraction and expansion of the inner wall panels causes some of the caulk to fracture and/or work its way out of the joints. Failure of the caulk seams allows moisture to enter the joints. Once inside the joints, the moisture freezes, thaws, expands and contracts, causing further failure of the seams. While the batten strips slow the entry of moisture into the joints, they also make it difficult for moisture already in the joints to escape. Bacteria may also enter the moisture-laden joints and may propagate over time.

One way to prevent moisture from entering the joints is to weld adjacent wall panels together. However, this technique is relatively expensive, and requires the use of specific expansion joints that permit the wall panels to expand and contract without fracturing the joints due to localized stresses.

There is a need or desire for an environmentally-controlled food container having relatively inexpensive seams which do not fracture or otherwise fail due to repeated thermal contraction and expansion of the inner wall panels.

SUMMARY OF THE INVENTION

The present invention is directed to an environmentally-controlled food container including a plurality of walls and joints between adjacent walls. Each wall includes an inner wall panel, an outer wall panel, and an insulation material between the inner and outer wall panels. A seaming tape is placed over the joints at least from inside the container, to prevent moisture and bacteria from entering the joints.

The seaming tape includes at least one outer film layer formed of a fluoropolymer, suitably polytetrafluoroethylene and at least one inner mesh layer. The fluoropolymer layer is flexible, and can flex as the adjacent wall panels expand and contract. The fluoropolymer layer provides a barrier to the passage of moisture and bacteria. Also, polytetrafluoroethylene has been determined by microbiological testing to have excellent hygienic surface characteristics, similar to stainless steel.

The inner mesh layer is formed of a material having a coefficient of thermal expansion within about ±10%, suitably within about ±5%, of a coefficient of thermal expansion of the material forming the adjacent wall panels. The mesh layer may have about the same coefficient of thermal expansion as the adjacent wall panels, and may be formed of the same material as the adjacent wall panels.

With the foregoing in mind, it is a feature and advantage of the invention to provide an environmentally-controlled food container, such as a refrigerator, freezer or oven, whose inner wall panel joints are covered with a seaming tape that expands and contracts along with the inner wall panels, and does not fracture due to thermally induced stresses.

It is also a feature and advantage of the invention to provide an environmentally-controlled food container whose inner wall panel joints are covered with a seaming tape that prevents the passage of moisture and bacteria.

DETAILED DESCRIPTION OF THE PRESENTLY PREFERRED EMBODIMENTS

Figure 1:
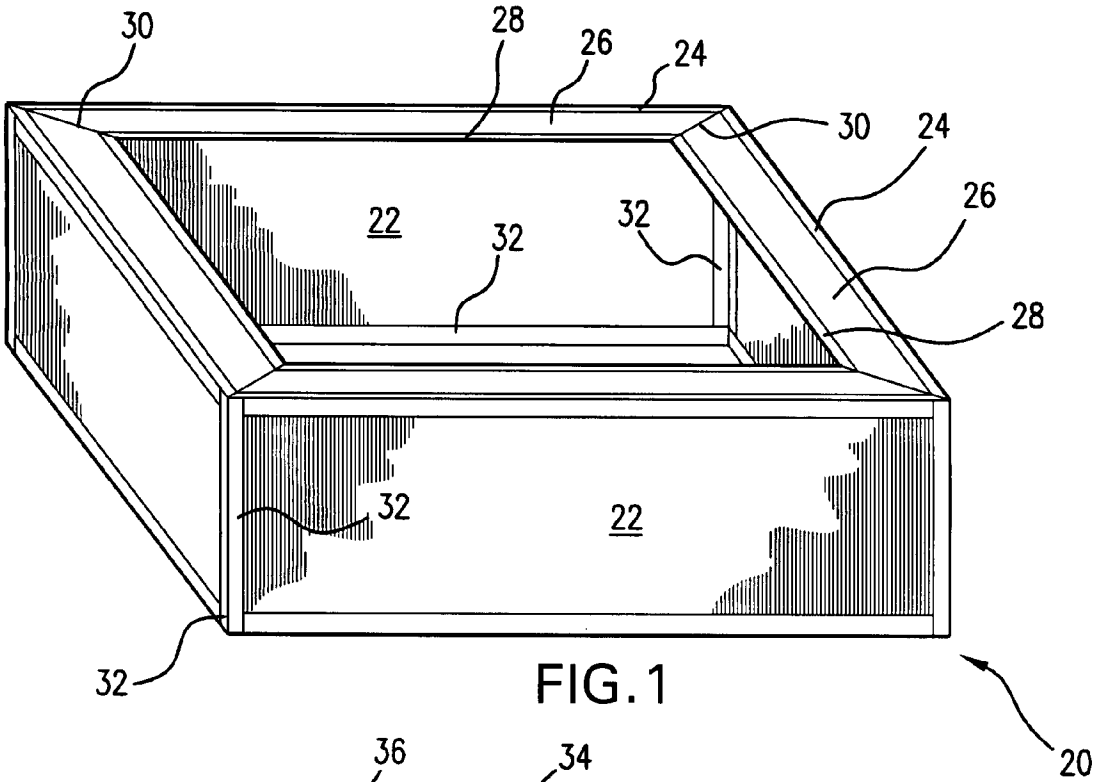
FIG. 1 is a perspective view of an environmentally-controlled food container, namely a refrigerator or freezer, according to the invention.

Referring to FIG. 1, an environmentally-controlled food container 20 is shown with its cover removed. The container 20 can be a refrigerator or freezer, or may operate in both modes, at temperatures above and below 0° C. The container 20 can also be designed as an oven. The container 20 includes rectangular side and bottom walls 22, joined edge to edge along joints 30. Each rectangular wall 22 includes an outer wall panel 24, an inner wall panel 28, and an insulation layer 26 between the outer and inner wall panels.

The outer and inner wall panels 24 and 28 may be formed of the same or different materials, and may each be formed of stainless steel, galvanized steel (e.g. painted galvanized steel), or another suitable metal or material. One suitable metal is type 304 stainless steel. Stainless steel is particularly suitable because it has surfaces which are smooth, non-porous, and easy to clean. Stainless steel surfaces are not conducive to bacterial retention or growth. In one embodiment, the outer and inner wall panels 24 and 28 are each formed of stainless steel. In another embodiment, inner wall panels 28 are formed of stainless steel and outer wall panels 24 are formed of painted galvanized steel. Each outer wall panel 24 may have a thickness of about 10 to about 25 gauge, suitably about 14 to about 20 gauge, depending on the size and capacity of the environmentally-controlled food container 20.

The insulation layer 26 may be formed of any conventional insulation material useful in refrigerators and freezers. Suitable insulation materials include polystyrene-based materials, such as FORMULAR 250 from the Dow Corning Co. The insulation layer 26 in each wall may have a thickness of about 5 cm to about 30 cm, suitably about 7 cm to about 20 cm.

The adjacent walls 22 can be connected together along joints 30 using conventional reinforcement techniques (not shown). Conventional reinforcement devices include braces, brackets, various other mechanical fasteners, and adhesives.

In accordance with the invention, each joint 30 is covered with a seaming tape 32 at least on the interior side of the container 20. This prevents moisture from entering the joints 30 from the inside, due to changes in temperature and condensation. Each joint 30 may also be covered with a seaming tape 32 on the exterior side of the container 20, and/or between the panels 24 and 28 of walls 22. This prevents moisture from entering the joints 30 from the outside, due to equipment washing, humidity and other factors.

Figure 2:
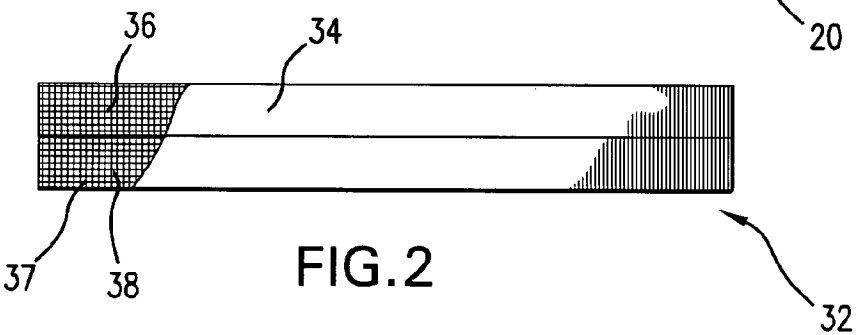
FIG. 2 is a partial cutaway view of a refrigerator or freezer joint covered by the seaming tape, according to the invention.

Referring to FIG. 2, seaming tape 32 includes a plastic film layer 34 which may be formed of a fluoropolymer, suitably polytetrafluoroethylene. The fluoropolymer layer 34 is intended to face away from the inner wall panels 28 and toward the interior, when the seaming tape 32 covers the joints 30 on the interior of the container 20. The fluoropolymer layer 34 is intended to face away from the outer wall panels 24 and toward the exterior, when the seaming tape 32 covers the joints 30 on the exterior of the container 20.

The fluoropolymer layer 34 serves as a flexible layer, and provides the seaming tape 32 with barrier properties, preventing the tranmission of water, water vapor and bacteria into the joints 30. Depending on the size of the refrigerator or freezer, the fluoropolymer layer 34 may have a thickness of about 20 microns to about 100 microns, suitably about 40 microns to about 60 microns. One suitable fluoropolymer layer is polytetrafluoroethylene film. Polytetrafluoroethylene film provides the tape 32 with a smooth, nonporous, easy to clean surface which is not conducive to bacterial retention or growth. In this respect, polytetrafluoroethylene film has hygienic surface characteristics similar to type 304 stainless steel.

The seaming tape 32 also includes a mesh layer 36, formed of a material having a thermal expansion coefficient within about ±10% of the thermal expansion coefficient of material forming the adjacent wall panels 24 or 28, which the tape 32 is in contact with. The mesh layer 36 may be formed of a material having a thermal expansion coefficient within about ±5% of the adjacent wall panel material, and may be formed of the same material as the adjacent wall panels, or a material having about the same thermal expansion coefficient.

For example, type 304 stainless steel has a thermal expansion coefficient of about 17.3 millionths/° C. at a temperature of 0° C. This means that if the temperature is raised or lowered from 0° C., the stainless steel will expand or contract by about 17.3 microns for every 1 meter of dimension in any direction, for every degree change in temperature. If the wall panels 24 or 28 adjacent to the seaming tape 32 are formed of type 304 stainless steel, the mesh layer 36 should be formed of a material having a coefficient of thermal expansion between about 15.6–19.0 millionths/° C., suitably between about 16.4–18.2 millionths/° C., particularly about 17.3 millionths/° C. The mesh layer 36 may also be formed of type 304 stainless steel.

The mesh layer 36 resembles a screen, and has a plurality of intersecting elements 37 defining a plurality of openings 38. The distance across each opening may range from about 10 microns to about one mm, and is suitably about 20 microns to about 100 microns. The mesh layer 36 may have a thickness, depending on the coarseness of the intersecting elements, between about 10 microns to about one mm, suitably about 20 microns to about 100 microns. The size of the opening 38, coarseness of the intersecting elements 37 and thickness of the mesh layer 36 may vary depending on the size of the container 20 and the weight of the adjacent panels 24 or 28.

The film layer 34 and mesh layer 36 may be bonded together using a variety of thermal or adhesive bonding techniques. For instance, the film layer 34 may be extruded onto the mesh layer 36 and pressed into the mesh layer 36 as the film layer 34 is cooled. Alternatively, the film layer 34 and mesh layer 36 may be separately formed and joined together using an adhesive. A seaming tape 32 having a polytetrafluoroethylene film and a stainless steel mesh layer already joined together is available from the W. L. Gore Company.

The seaming tape 32 may have a length and width tailored to the specific application, and to the specific joint 30 being covered. To apply the tape 32 to a joint 30, the wall panels 24 or 28 which will interface with the tape 32 may first be cleaned. Cleaning of wall panels 24 or 28 may be accomplished using chemicals, glass bead blasting, soda blasting or another suitable technique. Soda blasting involves the use of a high pressure spray of water and an environmentally safe, non-warping composition similar to conventional baking soda. Soda blasting will clean steel enclosures without rusting, abrading or otherwise damaging steel surfaces.

The seaming tape 32 is then applied over the joint 30 using a self-sticking adhesive previously applied to the mesh layer 36 of tape 32, or a solvent-based adhesive applied to either the panel surfaces surrounding the joint 30 or the mesh layer 36. Examples of self-sticking adhesives that can be applied during manufacture of seaming tape 32 include certain epoxy based adhesives and pressure sensitive adhesives. Examples of suitable solvent-based adhesives that can be applied during application of the seaming tape to the joint include adhesives based on poly urethane, polyurea, epoxy, and polyurethane-polyurea hybrid polymers. The solvent-based adhesive is desirably a quick-setting adhesive, i.e., one which hardens quickly after use. The adhesive may include two parts which are mixed together at the time of application, resulting in fast setting.

To ensure optimal adhesion between the seaming tape 32 and the wall panels 24 or 28, both the cleaning and application of the seaming tape should occur at a temperature above 0° C., suitably about 5° C. or higher, desirably at ambient temperature of about 20° C. or higher. By performing these steps at ambient temperature, the wall panel temperature, cleaning substance, seaming tape and adhesive will all have about the same temperature, and interactions caused by sharp temperature differences will be avoided.

While the embodiments of the invention described herein are presently preferred, various modifications and improvements can be made without departing from the spirit and scope of the invention. The scope of the invention is indicated by the appended claims, and all changes that fall within the meaning and range of equivalents are intended to be embraced therein.

We claim:

1. An environmentally-controlled food container, comprising:

a plurality of walls, each including an outer panel, an inner panel, and an insulation layer between the outer and inner panels;

the walls being joined edge to edge along joints; and a seaming tape covering one or more joints at least on an interior side of the container;

the inner panels being formed of a material having a coefficient of thermal expansion;

the seaming tape including a plastic film and a mesh layer formed of a material having a coefficient of thermal expansion within about ±10% of the coefficient of thermal expansion of the inner panel material.

2. The container of, claim 1, wherein the inner panels comprise stainless steel.

3. The container of claim 1, wherein the inner panels comprise galvanized steel.

4. The container of claim 1, wherein the plastic film layer comprises a fluoropolymer.

5. The container of claim 1, wherein the plastic film layer comprises polytetrafluoroethylene.

6. The container of claim 1, wherein the mesh layer has a coefficient of thermal expansion within about ±5% of the coefficient of thermal expansion of the inner panel material.

7. The container of claim 1, wherein the mesh layer and the inner panels are formed of the same material.

8. The container of claim 1, further comprising a seaming tape covering one or more joints on the exterior side of the container.

9. An environmentally-controlled food container, comprising:

a plurality of walls, each including an outer panel, an inner panel, and an insulation layer between the outer and inner panels;

the walls being joined edge to edge along joints; and a moisture-impervious seaming tape covering each joint at least on an interior side of the container;

the inner panels being formed of metal;

the seaming tape including a moisture-impervious film layer and mesh layer formed of a metal.

10. The container of claim 9, wherein the inner panels comprise steel.

11. The container of claim 10, wherein the outer panels comprise steel.

12. The container of claim 10, wherein the inner mesh layer comprises steel.

13. The container of claim 9, wherein the film layer comprises a fluoropolymer.

14. The container of claim 13, wherein the fluoropolymer comprises polytetrafluoroethylene.

15. The container of claim 9, further comprising a seaming tape covering each joint on an exterior side of the container.

16. An environmentally-controlled food container, comprising:

a plurality of walls, each including an outer panel, an inner steel panel, and an insulation layer between the outer and inner panels;

the walls being joined edge to edge along joints; and a moisture-impervious seaming tape covering one or more joints on at least an interior side of the container;

the seaming tape including a moisture-impervious plastic film layer and a steel mesh layer.

17. The container of claim 16, wherein in the inner steel panel comprises stainless steel and the steel mesh layer comprises stainless steel.

18. The container of claim 16, wherein the inner steel panel comprises galvanized steel and the steel mesh layer comprises galvanized steel.

19. The container of claim 16, wherein the plastic film layer comprises a fluoropolymer.

20. The container of claim 16, wherein the fluoropolymer comprises polytetrafluoroethylene.

21. The container of claim 16, wherein the outer panels comprise steel.

22. The container of claim 16, comprising a seaming tape covering each joint on the interior side of the container.

23. The container of claim 16, further comprising a seaming tape covering one or more joints on an exterior side of the container.

24. The container of claim 22, further comprising a seaming tape covering each joint on an exterior side of the container.

25. The container of claim 16, comprising a refrigerator.

26. The container of claim 16, comprising a freezer.

27. The container of claim 16, comprising an oven.

* * * * *